US005478217A

United States Patent [19]

Jones

[11] Patent Number: 5,478,217

[45] Date of Patent: Dec. 26, 1995

[54] RECIPROCATING PUMP FOR PUMPING VISCOUS MATERIALS

[75] Inventor: David R. Jones, Southwater, England

[73] Assignee: Duracell Inc., Bethel, Conn.

[21] Appl. No.: 197,415

[22] Filed: Feb. 17, 1994

[30] Foreign Application Priority Data

Feb. 19, 1993 [GB] United Kingdom ..... 9303400

[51] Int. Cl.[6] ..... F04B 19/02

[52] U.S. Cl. ..... 417/461; 417/519

[58] Field of Search ..... 417/518, 519, 417/461, 462; 137/876, 565

[56] References Cited

U.S. PATENT DOCUMENTS

| | | | |
|---|---|---|---|
| 1,295,211 | 2/1919 | Riedler | 417/461 |
| 1,568,170 | 1/1926 | Le Bret | 417/519 |
| 2,163,817 | 12/1937 | Johnson | 417/519 |
| 2,529,457 | 11/1950 | Nilsson | 417/461 |
| 2,553,162 | 5/1951 | Bancroft | 417/461 |
| 2,865,292 | 12/1958 | Raibaud | 417/519 |
| 3,302,752 | 2/1967 | Shiokawa | 417/461 |
| 3,967,612 | 7/1976 | Yamada | 417/461 |
| 4,036,326 | 7/1977 | Mukai et al. | 417/461 |
| 4,231,716 | 11/1980 | Kubota et al. | 417/461 |
| 4,797,073 | 1/1989 | Kubota | 417/461 |

*Primary Examiner*—Richard A. Bertsch
*Assistant Examiner*—Peter G. Korytnyk
*Attorney, Agent, or Firm*—Ronald S. Cornell; Barry D. Josephs

[57] ABSTRACT

A positive displacement pump is disclosed having a pump body, a cylinder member rotatably accommodated within the pump body and a piston member within the cylinder member. At least a portion of the cylinder member is rotatable about the cylinder axis in step with the reciprocal motion of the piston relative to the cylinder. The rotatable portion of the cylinder has as least one flow port which communicates with the working volume of an intake or discharge port for material being pumped. The rotatable portion of the cylinder preferably has two flow ports, one which will communicate with the intake port and the other which will communicate with the discharge port.

6 Claims, 3 Drawing Sheets

RECIPROCATING PUMP FOR PUMPING VISCOUS MATERIALS

This invention relates to positive displacement (volumetric) pumps for pumping viscous materials, for example zinc paste gels used in the manufacture of dry electrical storage cells.

The handling and dispensing of zinc paste gels and similar viscous fluid materials presents problems. In the case of electrochemical cells, dispensing must be rapid, accurate, and reliable.

Positive displacement reciprocating piston pumps are commonly used, in particular pumps manufactured by Hibar Systems Limited. The Hibar pump comprises a reciprocating piston or plunger operating in a cylinder, the cylinder being connected at one end to a changeover valve by which the cylinder is connected to an inlet during a suction stroke and is then connected to an outlet during a dispensing stroke of the plunger. The valve is coupled to the cylinder end and comprises a valve member which rocks about an axis perpendicular to that of the cylinder and plunger. While this pump is reasonably satisfactory, it can have problem with sealing between the piston chamber and the rotary valve, air can enter through valve seals, which are dry, or even with the material being pumped. A restriction exists between the piston chamber and the valve, which can act as an air trap for air which has entered through a valve seal or with the material.

According to the present invention, in a positive displacement piston or plunger pump, the cylinder within which the piston or plunger reciprocates itself constitutes an intake/discharge valve member, and for movement between intake and discharge positions is rotatable about the axis of the cylinder.

This provides a construction which is simpler and more reliable than the conventional Hibar metering pump and valve assembly.

Preferably, the rotary interface between the valve member/cylinder and the pump body housing it communicates with a source of lubricating and/or sealing liquid, such as to provide a wetted seal about the valve member. The said source may be that conventionally provided for the piston or plunger.

The invention will be further described with reference to the accompanying drawings in which:

FIG. 1 schematically illustrates a conventional Hibar metering pump.

Figure 1:
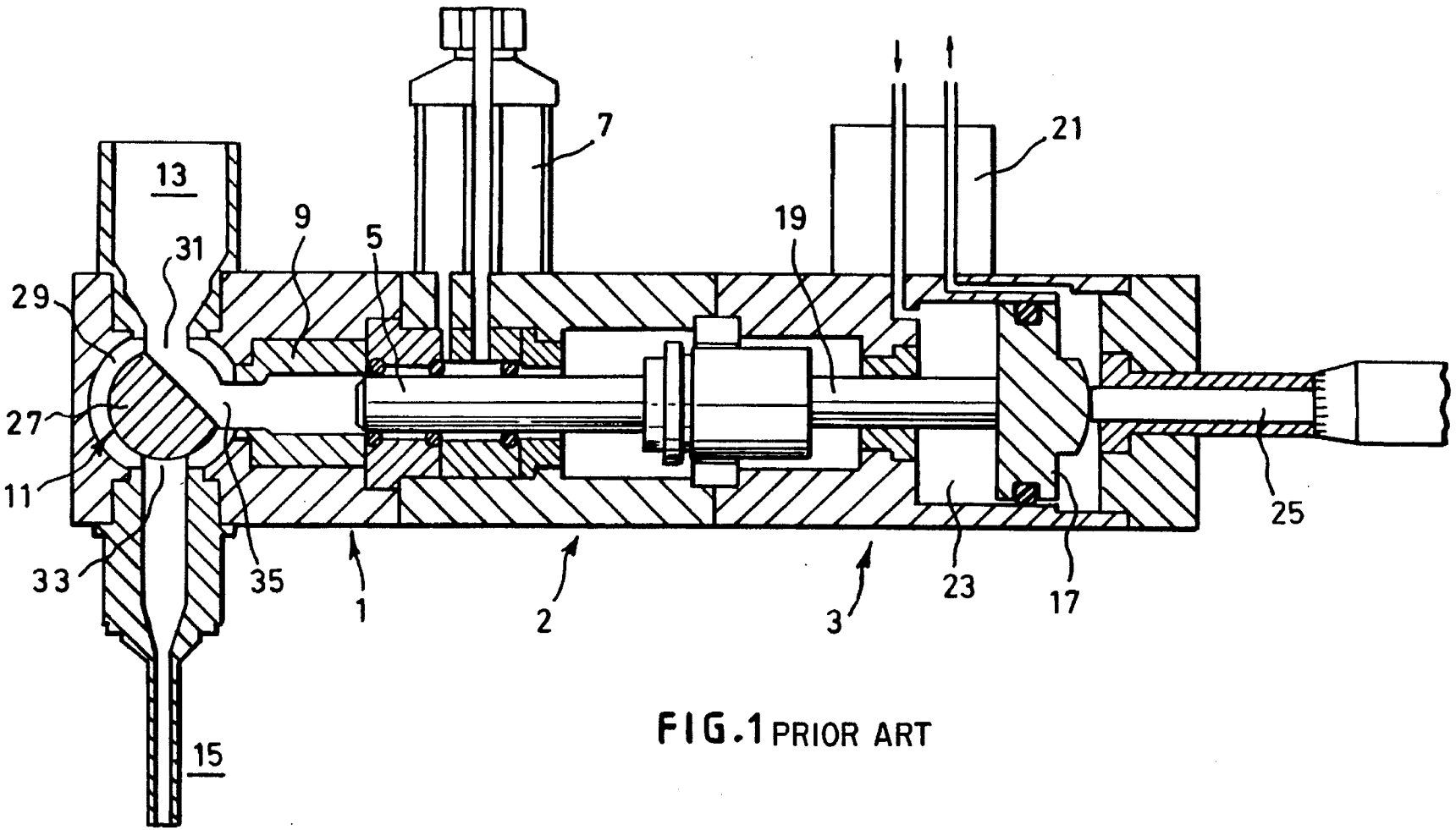
FIG. 1 PRIOR ART

The conventional Hibar pump shown in FIG. 1 has a pump body composed of a number of sections namely pump head section 1, mid section 2, and drive section 3, assembled end to end in line.

The mid section accommodates and longitudinally guides a plunger 5 and is provided with a wet cup reservoir 7 for lubricating the plunger, and with appropriate O-ring plunger seals.

The pump head 1 contains a pump cylinder 9 open at both ends, and a rotary valve 11 which communicates with an inlet union 13 and an outlet union 15.

The drive section 3 contains a fluid pressure-operated piston 17, a piston rod 19 of which is coupled to the rear end of the pump plunger 5. A valve block 21 controls fluid flow to and from the drive cylinder 23 in which the piston 17 can reciprocate, whereby the pump plunger can be reciprocated in the pump cylinder 9.

A micrometer stop 25 defines the travel of the drive piston 17 and therefore of the pump plunger 5, so that the volume displaced and thereby dispensed by the pump in each stroke can be adjusted.

Alternatively the drive section may comprise a mechanical or electrical drive of any suitable type capable of reciprocating the plunger with an accurately defined stroke.

The valve 11 comprises a valve member 27 of part-circular cross section, with its axis perpendicular to and intersecting the longitudinal axis of the pump cylinder and plunger. The valve member 27 can be rocked through 90° about its axis, by a rack and pinion mechanism, in synchronism with the forward and return motion of the pump plunger.

FIG. 1 shows the positions of the components at the end of the intake or suction stroke. The valve member 27 is in its "fill" position, connecting the open end of the pump cylinder to the inlet union 13. With the valve member in this position, the pump plunger has been fully retracted, thereby drawing into the cylinder 9 the material to be dispensed, for example gelled zinc paste. The valve member 27 rocks within a valve sleeve 29 which has an intake opening 31 communicating with the inlet union 13, a discharge or dispensing opening 33 opposite the opening 31 and communicating with the outlet union 15, and between these an opening 35 communicating with the end of the pump cylinder. In order to dispense a metered quantity of material (determined by the micrometer stop 25), the valve member 27 is now rotated 90° clockwise so that it closes the opening 31 and permits communication between the openings 33, 35. The pump plunger 5 is then advanced to expel through the outlet union 15 the material previously drawn into the pump cylinder 9. Then the valve member 27 is returned to the position shown in FIG. 1 and the pump plunger is again retracted to draw into the pump cylinder a fresh charge of material to be dispensed.

Sealing is required between the cylinder 9 and the valve sleeve 29, and between both of these and the pump head housing. This is difficult to achieve reliably.

The seals provided as the valve are dry and air can enter through them. Air can also be drawn in through the unions 13, 15.

It will be seen that there is a restriction between the cylinder and the valve, in the region of the opening 35. This region can form an air trap, leading to inaccurate metering.

Figure 2:
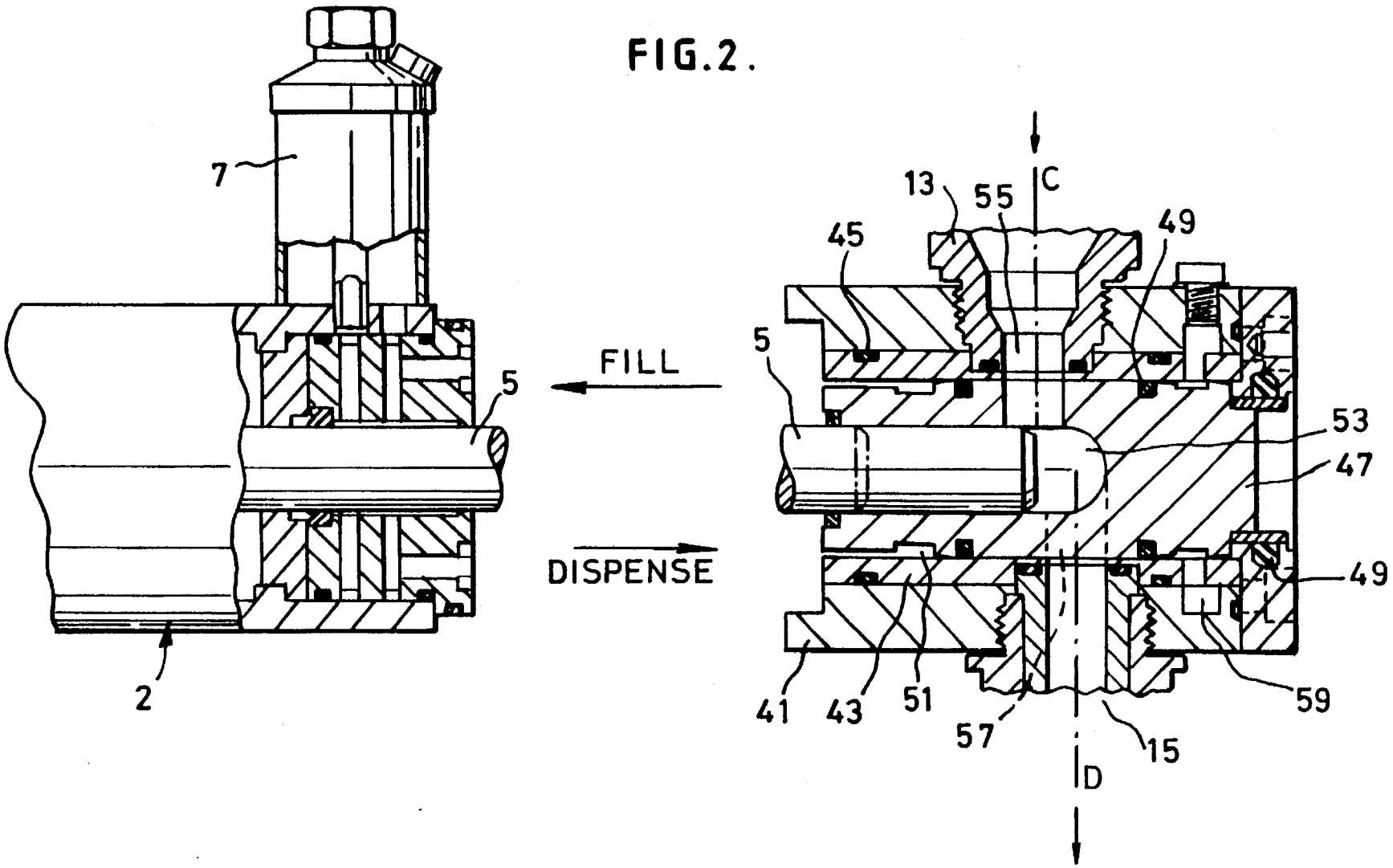
FIG. 2 shows a modified pump head in accordance with the present invention.
Figure 3:
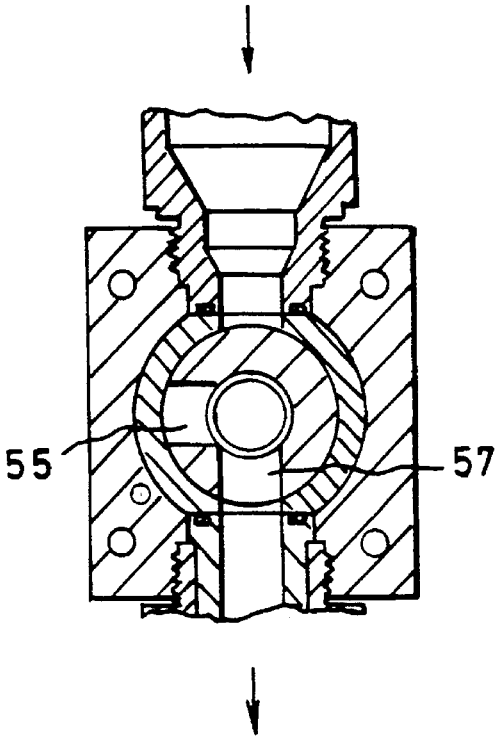
FIG. 3 and FIG. 4 are cross sections on the line C–D in FIG. 2, showing the dispensing and filling conditions respectively.
Figure 4:
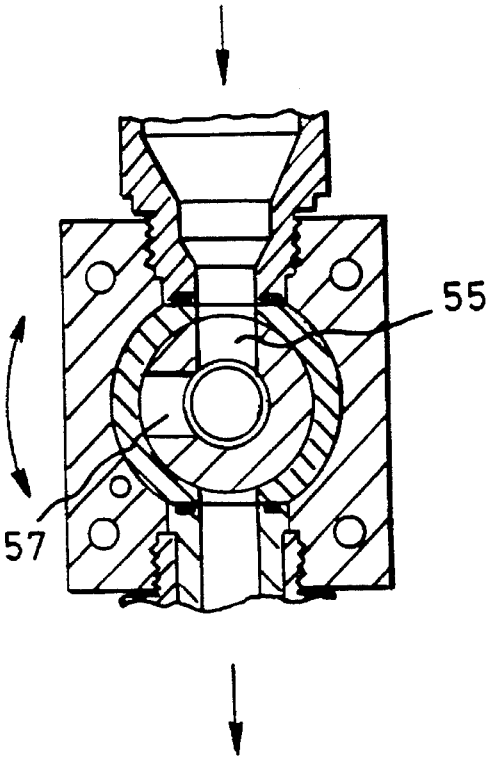

FIGS. 2 to 4 show a modified pump head embodying the present invention, which can be used in conjunction with substantially conventional pump mid section 2 and drive section 3. The drive section may be air-powered (as shown), mechanical, or electrical (e.g. a servo motor drive).

This pump head comprises a housing 41 containing a sleeve or liner 43 provided with external static seals 45.

The sleeve 43 defines a cylindrical bore within which is a cylindrical member 47 which acts both as the pump cylinder and as the intake/discharge valve member. This can rotate but cannot move longitudinally within the sleeve or liner 43, and is provided with peripheral seals 49. The member 47 extends to a position adjacent the mid-section 2 provided with the lubricator 7. Lubrication channels 51, 59 are provided on the member 47 and in the pump head, arranged to communicate with the lubricant reservoir 7 so as to lubricate the rotatable member 47. This provides a totally wetted sealing configuration between the member 47 and the enclosing sleeve and housing.

The member 47 contains a cylinder bore 53, a radial intake opening 55 placed slightly short of the end of the cylinder bore, and a discharge opening 57 communicating with the end of the cylinder bore and extending radially, at right angles to the opening 55, as can be seen in FIGS. 3 and 4.

The cylinder/valve member 47 can rock about its axis between the position shown in FIG. 3 in which the valve opening 57 communicates with the outlet or dispensing union 15 and the opening 55 is blocked, permitting metered fluid material to be dispensed by the plunger 5 from the cylinder bore 53 to the outlet; and the position shown in FIG. 4 in which the opening 57 is blocked while the opening 55 connects the inlet union 13 to the cylinder bore so that material can be drawn into the cylinder by retraction of the pump plunger.

The member 47 is rocked between these positions in synchronism with the forward and reverse motion of the pump plunger by any suitable means, for example a rack and pinion mechanism. Material to be metered and dispensed is thereby alternately drawn into and dispensed from the pump. Specifically:

With the member 47 in the position shown in FIG. 4, the pump plunger is retracted.

Member 47 is rotated 90° to the position shown in FIG. 3.

The pump plunger is advanced to dispense indrawn gel or fluid.

Member 47 is returned to position shown in FIG. 4. Pump plunger is again retracted.

Because the pump cylinder and valve member are one and the same, obviously there is no need for sealing between them. Furthermore, no restriction or potential air trap exists between the pump cylinder and the valve. The illustrated pump head provides a better flow path for the pumped medium than the conventional Hibar pump head, has a totally wetted seal configuration, and can have a reduced width compared with the Hibar valve. The totally wetted seals can be reduced or eliminate air ingress in operation.

What is claimed is:

1. A positive displacement pump comprising a pump body, an intake port and a discharge port, a cylinder member rotatably accommodated within said pump body and a piston member in the cylindrical member, wherein the piston member is reciprocatable in the axial direction of the cylinder member, wherein at least a portion of the cylinder member is rotatable about the cylinder axis in step with the reciprocal motion of the piston relative to the cylinder, wherein said portion of the cylinder member has two distinct openings in its wall, said distinct openings forming two distinct flow ports oriented at respective different positions about the cylinder axis, wherein said portion functions as an intake/discharge valve of the pump and has a first rotational position in which the first of said flow ports communicates with the intake port and the second flow port is closed, and wherein said portion has a second rotational position in which the second flow port communicates with the discharge port and the first flow port is closed, wherein said two flow ports are fully displaced from each other along both the length and circumference of the cylinder member.

2. The pump of claim 1 wherein the flow port closest to the end of the cylinder nearest the termination of the piston's stroke into the cylinder communicates with the working volume of the discharge port.

3. The pump of claim 1 wherein the two flow ports are oriented at about a 90° angle to each other.

4. The pump of claim 1 wherein there is an interface between the pump body and cylinder member.

5. The pump of claim 4 wherein said interface communicates with a source of liquid which provides a wetted seal at said interface to that said portion of the cylinder which functions as in intake/discharge valve is sealed from said pump body.

6. The pump of claim 4 wherein said interface communicates with a liquid which functions to lubricate said interface and aid in sealing said portion from the pump body.

* * * * *